United States Patent [19]

Dye et al.

[11] Patent Number: 4,945,905

[45] Date of Patent: Aug. 7, 1990

[54] COMPRESSIBLE BOOT

[75] Inventors: John F. Dye, Elgin; Mark Kolstedt, Algonquin, both of Ill.

[73] Assignee: The Kendall Company, Boston, Mass.

[21] Appl. No.: 153,755

[22] Filed: Feb. 8, 1988

[51] Int. Cl.[5] ..... A61H 1/00

[52] U.S. Cl. ..... 128/24 R; 128/64; 128/80 R; 128/DIG. 20

[58] Field of Search ..... 128/24 R, 132 R, 153, 128/160, 594, 894, DIG. 20, 80 R, 87 R, 64; 36/71

[56] References Cited

U.S. PATENT DOCUMENTS

| | | | |
|---|---|---|---|
| 2,305,926 | 12/1942 | Kohler | 128/132 R |
| 2,365,807 | 12/1944 | Dialynas | 128/594 |
| 2,582,648 | 1/1952 | Mowbray | 128/153 |
| 2,669,989 | 2/1954 | Shoueair | 128/132 R |
| 3,083,708 | 4/1963 | Gottfried | 128/DIG. 20 X |
| 3,153,413 | 10/1964 | Gottfried | 128/24 R |
| 3,186,404 | 6/1965 | Gardner | 128/24 R |
| 3,338,237 | 8/1967 | Sconce | 128/DIG. 20 X |
| 3,469,576 | 9/1969 | Smith et al. | 128/594 |
| 3,824,992 | 7/1974 | Nicholson et al. | 128/DIG. 20 X |
| 4,123,855 | 11/1978 | Thedford | 128/594 |
| 4,573,453 | 3/1986 | Tissot | 128/24 R |
| 4,614,179 | 9/1986 | Gardner et al. | 128/DIG. 20 X |
| 4,628,911 | 12/1986 | Bornstein | 128/DIG. 20 X |
| 4,730,610 | 3/1988 | Graede | 128/DIG. 20 X |

*Primary Examiner*—Mickey Yu

[57] ABSTRACT

A foot sleeve for the enclosure of a patient's foot by a single pressurized chamber, which chamber is folded so as to have any sealed margins at the side or tow portions of a patient's foot. By having the sealed edges at the side portions of the sleeve or boot, the top portion of the sleeve is able to receive a full compression chamber completely thereacross.

6 Claims, 2 Drawing Sheets

COMPRESSIBLE BOOT

BACKGROUND OF THE INVENTION

1. Field of the Invention

This invention relates to therapeutic and prophylactic devices, and more particularly, to medical devices for applying compressive pressure against a patient's foot.

2. Prior Art

Edema is the presence of abnormally large amounts of fluid in the intercellular tissue spaces of the body. Treatment has involved compression of limbs and feet.

Devices for generating compression for treating edema or thrombosis are shown in U.S. Pat. No. 4,013,069 to Hasty. More recent devices for generating pressures for sleeves enwrapping patient's limbs are shown in U.S. patent application Ser. No. 157,689, filed Feb. 18, 1988 entitled: "Portable Sequential Compression Device," incorporated herein by reference. Sleeves which are utilized to enwrap a patient's limbs are shown in U.S. patent application Ser. No. 098,252, filed Sept. 18, 1987 entitled: "Multilayered Sequential Compression Sleeve," which is incorporated herein by reference.

Problems with "boots" or "sleeves" for the feet are not properly addressed. Compressive sleeves in use for feet have compartments which are divided by seams down the middle of the foot. This is improper because it is the top portion of the foot that swells the most from edema.

It is an object of the present invention to simplify and improve the prior art foot sleeve.

BRIEF SUMMARY OF THE INVENTION

The present invention comprises a foot sleeve for providing a compressible chamber over the entire top of the foot. The foot sleeve comprises a pair of generally elongated fluid impervious sheets of clear plastic material, generally half of which will cover the bottom of the foot, and the other half will cover the top of the foot. The material is folded at the toe end. The sheets are sealed along their longitudinal side edges.

The sheets have a generally rectangular pad, sealingly received between the sheets, at the location for the bottom of a foot. The sheets are sealed also at their common peripheral edges so as to define a single compressive chamber for the top of the foot and for the edge portions along the bottom of the foot. A pair of supply ports are arranged through the outermost sheet to provide compressed air into the chamber. The lowermost portion of the pair of sheets has a distal portion which is bendable up and around the ankle of a patient wearing the boot. The uppermost (top) portion has a distal portion that wraps about the front of an ankle of a patient wearing the boot. An attachment means to attach the heel wrap and the front ankle portions together, such as gripping means marketed under the tradename "Velcro" may be used to hold them on a foot.

An alternative embodiment of the boot comprises a similar pair of sheets, however, the sheets are folded along one side of the foot portion instead of at the toe portion as was the case in the aforementioned embodiment.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
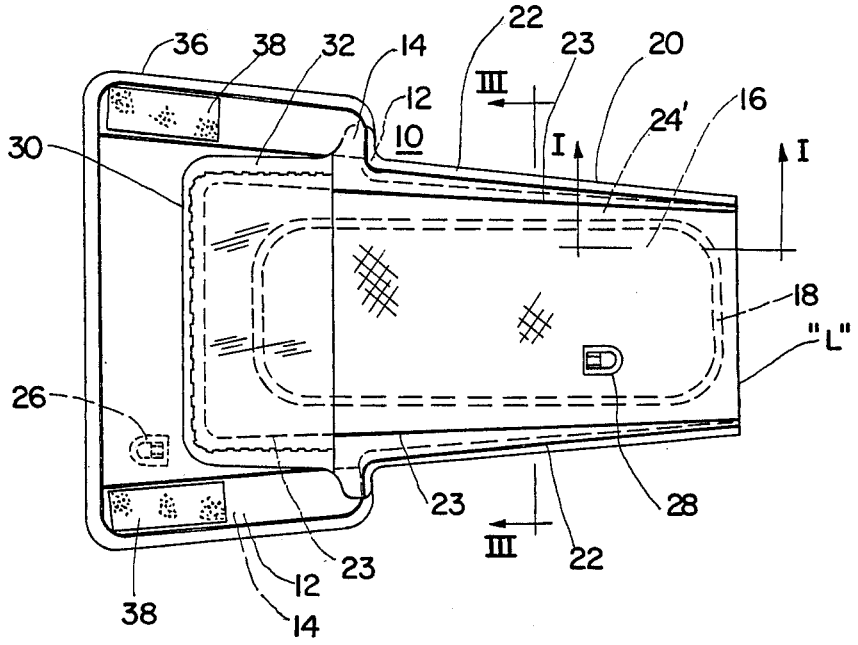
FIG. 1 is a plan view of a compressible sleeve or boot manufactured according to the principles of the present inventions.

Referring to the drawings in detail, and particularly to FIG. 1, there is shown a compressive boot sleeve 10 for a patient's foot. The sleeve 10 comprises a pair of elongated fluid impervious flexible sheets 12 and 14, folded along a line "L" at the toe, whereupon the lower half of the sheets 12 and 14 are arrangable for under the bottom of a patient's foot, and the other half of the sheets 12 and 14 being the covering for the top of a patient's foot.

Figure 2:
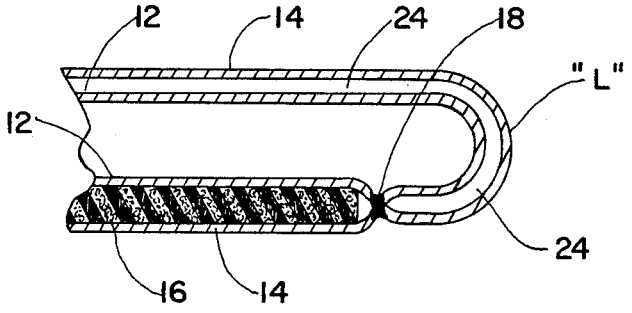
FIG. 2 is a view taken along the lines II—II of FIG. 1.
Figure 3:
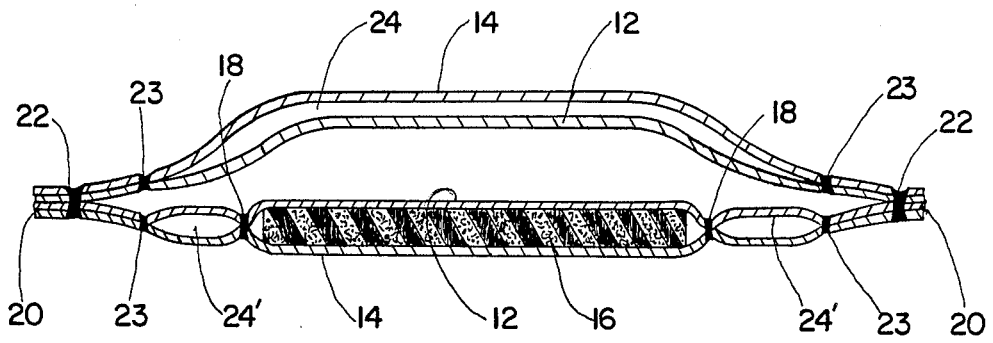
FIG. 3 is a view taken along the lines III—III of FIG. 1.

A cushion pad 16 of generally rectangular configuration, is disposed on the bottom half of the- sleeve 10, between the sheets 12 and 14, as shown in FIGS. 2 and 3. A sealed margin 18 locks the pad 16 into its own chamber. The pad 16 is arranged so as to act as a cushion for a patient's foot placed within the sleeve 10.

The elongated sheets 12 and 14 have a common periphery 20 along which a seal margin 22 extends. A single chamber 24 is defined between the sheets 12 and 14 and a second margin 23, the chamber 24 being folded at "L" adjacent the toe. The chamber 24 is divided into parallel sub-chambers 24' longitudinally adjacent the pad 16. A pair of pressurized fluid supply ports 26 and 28 are disposed through the outermost sheet 14.

The distal end 30 of the top outermost sheet 14 has a cloth layer 32 thereon. The distal end 30 of the top sheet 14 is bendable upwardly so as to wrap around the front portion of a patient's limb. The distal end 36 of the bottom outermost sheet 14 has a pair of gripping means 38 thereon. The gripping means 38 may comprise attachment material such as that marketed under the trade name "Velcro." The distal end 36 of the bottom outermost sheet 14 is foldable to wrap around the back heel part of a patient's foot, and the gripping means 38 secures itself to the cloth 32 around the front portion of the patient's ankle. Pressurized fluid may then be supplied to apply compressive pressure across the entire top portion of a patient' foot.

Figure 4:
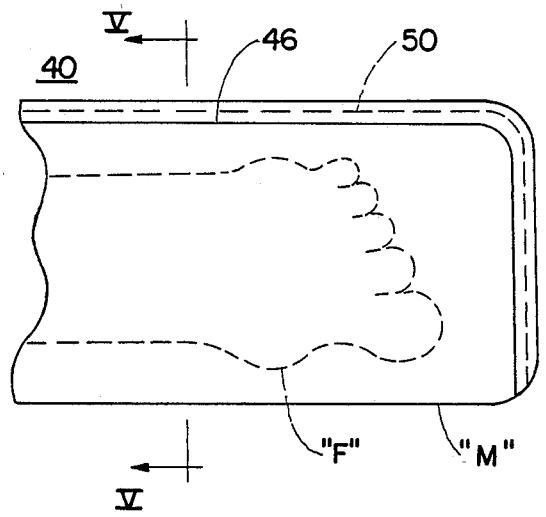
FIG. 4 is a partial plan view of an alternative embodiment of the boot.
Figure 5:
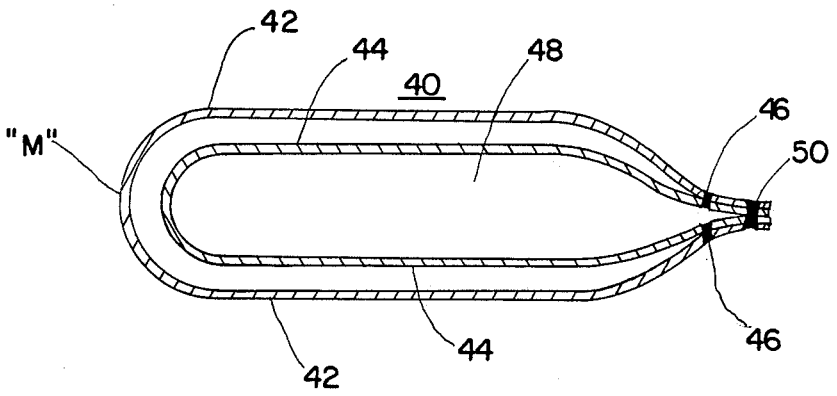
FIG. 5 is a view taken along the lines V—V of FIG. 4.

An alternative embodiment is shown in FIG. 4, wherein a foot sleeve 40 is arranged generally similar to the foot sleeve 10 shown in FIG. 1. The foot sleeve 40 has a fold line "M" along one longitudinal side instead of across the toe portion. The foot sleeve 40 comprises a pair of fluid impervious sheets 42 and 44, which are sealed adjacent their common peripheries at their margins 46 and together to form a sheath 48 by sealing the inner sheet 44 at a margin 50, as shown in FIGS. 4 and 5. The sealed margins 46 and 50 may be made by heat sealing, adhesives or the like.

Each embodiment requires that the particular margins are at the side portions of a foot "F" inserted within the space formed by the folded sheets, and not at the top or bottom portions of a foot, so as to be irritating thereat.

We claim:

1. A foot sleeve adapted to enclose a foot of a patient and to apply compressive pressure to the top of said foot to the exclusion of compressive pressure to the sole thereof, said sleeve comprising:

first and second fluid-impervious flexible sheets in superposition with superposed peripheral portions sealed together to form a common periphery;

said sheets being folded in an overlapping relationship at an approximate mid-point between opposed peripheral portions, the overlapping edges of said folded sheets being sealed together to form said sleeve having a closed end and an opposed open end through which a foot can be inserted with the toes of the foot adjacent said closed end and the foot seated on the lowermost portion of said sleeve;

fluidtight seal means between said common periphery sealing said sheets to define a single inflatable chamber between said sheets within said seal means into which fluid may be introduced to inflate said chamber and thereby apply compressive pressure to the sides and top of the foot within said sleeve;

said lowermost portion having a fluidtight seal around the periphery thereof, whereby said lowermost portion is not in fluid communication with said inflatable chamber and is therefore non-inflatable beneath the foot seated thereon; and means for introducing fluid within said inflatable chamber.

2. A foot sleeve as defined in claim 1 wherein a pad of cushion material is disposed between said sheets at said lowermost portion.

3. A foot sleeve as defined in claim 1 wherein said inflatable chamber extends across said fold.

4. A foot sleeve as defined in claim 1 wherein said fold defines said closed end of said sleeve.

5. A foot sleeve as defined in claim 1 wherein said means for introducing fluid comprises port means for introducing air into said inflatable chamber.

6. A foot sleeve as defined in claim 1 wherein said open end is bendable for enclosing a patient's ankle.

* * * * *